US008870428B2

(12) United States Patent
Unger et al.

(10) Patent No.: US 8,870,428 B2
(45) Date of Patent: Oct. 28, 2014

(54) ELONGATED LED LIGHTING ARRANGEMENT

(75) Inventors: Blair L. Unger, Rochester, NY (US); Gregory P. Frankiewicz, Mayfield Heights, OH (US); Joseph G. Kaveski, Leawood, KS (US); Roger F. Buelow, II, Pepper Pike, OH (US); John M. Davenport, Middleburg Heights, OH (US)

(73) Assignee: Energy Focus, Inc., Solon, OH (US)

( * ) Notice: Subject to any disclaimer, the term of this patent is extended or adjusted under 35 U.S.C. 154(b) by 0 days.

(21) Appl. No.: 13/528,584

(22) Filed: Jun. 20, 2012

(65) Prior Publication Data

US 2013/0343079 A1 Dec. 26, 2013

(51) Int. Cl.
*F21V 7/04* (2006.01)

(52) U.S. Cl.
USPC ..... 362/555; 362/217.01; 362/551

(58) Field of Classification Search
USPC ..... 362/555, 217.01, 551
See application file for complete search history.

(56) References Cited

U.S. PATENT DOCUMENTS

| | | | | |
|---|---|---|---|---|
| 4,996,632 | A | 2/1991 | Aikens | |
| 6,601,984 | B2 * | 8/2003 | Yamamoto et al. | 362/600 |
| 6,637,905 | B1 | 10/2003 | Ng et al. | |
| 6,795,243 | B1 | 9/2004 | McGettigan et al. | |
| 7,163,326 | B2 | 1/2007 | Cassarly et al. | |
| 7,164,819 | B2 | 1/2007 | Jenson et al. | |
| 7,194,184 | B2 | 3/2007 | Buelow, II et al. | |
| 7,234,820 | B2 | 6/2007 | Harbers et al. | |
| 7,330,632 | B1 | 2/2008 | Buelow, II et al. | |
| 7,478,936 | B2 | 1/2009 | Chen | |
| 7,513,669 | B2 | 4/2009 | Chua et al. | |
| 7,543,959 | B2 | 6/2009 | Bierhuizen et al. | |
| 7,549,783 | B2 | 6/2009 | Cassarly et al. | |

(Continued)

FOREIGN PATENT DOCUMENTS

| | | | |
|---|---|---|---|
| JP | 2002-358812 | A | 12/2002 |
| KR | 10-2012-0056001 | A | 6/2012 |
| WO | 2006035388 | A2 | 4/2006 |

OTHER PUBLICATIONS

Cree, Inc., Cree XLamp XT-E Royal Blue LEDs, Product Family Data Sheet, 2011, Cree Inc., Durham, NC, USA.

(Continued)

*Primary Examiner* — Evan Dzierzynski
(74) *Attorney, Agent, or Firm* — Bruzga & Associates; Charles E. Bruzga; Jay S. Pattumudi

(57) ABSTRACT

An elongated LED lighting arrangement comprises an elongated fiberoptic light pipe having an exteriorly facing sidewall between its ends. The light pipe is constructed to promote TIR of light between the ends. A first LED light source is tuned to efficiently provide light within a wavelength range to the pipe. Light-extracting means are applied along the light pipe along the main path of TIR light propagation, and comprise down-converting means tuned to efficiently convert light rays from the LED light source within the wavelength range to lower-energy light rays at respectively longer wavelengths and light-scattering means for extracting from the pipe some light rays within the wavelength range without changing the wavelengths of the foregoing light. The light emitted by the down-converting means and the light-scattering means intermix to produce light, the majority of which has a composite color determined by the foregoing light emitted and the foregoing light extracted.

20 Claims, 13 Drawing Sheets

(56) References Cited

U.S. PATENT DOCUMENTS

| | | | | |
|---|---|---|---|---|
| 7,709,811 | B2 | 5/2010 | Conner | |
| 7,744,241 | B2 | 6/2010 | Xu | |
| 7,837,348 | B2 * | 11/2010 | Narendran et al. | 362/231 |
| 7,976,204 | B2 | 7/2011 | Li et al. | |
| 8,002,448 | B2 | 8/2011 | Chen | |
| 8,004,172 | B2 | 8/2011 | Hussel et al. | |
| 8,070,341 | B2 * | 12/2011 | Chinniah et al. | 362/551 |
| 2004/0066659 | A1 * | 4/2004 | Mezei et al. | 362/555 |
| 2005/0063197 | A1 * | 3/2005 | Nightingale et al. | 362/551 |
| 2005/0270775 | A1 | 12/2005 | Harbers et al. | |
| 2006/0152172 | A9 * | 7/2006 | Mueller et al. | 315/291 |
| 2006/0227302 | A1 | 10/2006 | Harbers et al. | |
| 2007/0195548 | A1 * | 8/2007 | Wang | 362/555 |
| 2007/0263405 | A1 | 11/2007 | Ng et al. | |
| 2007/0291491 | A1 | 12/2007 | Li et al. | |
| 2007/0291505 | A1 | 12/2007 | Fortenberry et al. | |
| 2007/0297061 | A1 | 12/2007 | Kyomoto et al. | |
| 2008/0158873 | A1 | 7/2008 | Bierhuizen et al. | |
| 2009/0244922 | A1 | 10/2009 | Hayakawa et al. | |
| 2010/0008101 | A1 | 1/2010 | Bucher | |
| 2010/0165621 | A1 | 7/2010 | Hoffend, Jr. et al. | |
| 2010/0188867 | A1 | 7/2010 | Li | |
| 2010/0275999 | A1 | 11/2010 | Buelow, II | |
| 2010/0296312 | A1 | 11/2010 | Van Gorkom et al. | |

OTHER PUBLICATIONS

Cree, Inc., Cree XLamp XT-E LEDs, Product Family Data Sheet, 2011-2012, Cree Inc., Durham, NC, USA.

Intematix, NYAG4653 Datasheet, 2012, Intematix, Fremont, CA, USA.

* cited by examiner

ELONGATED LED LIGHTING ARRANGEMENT

FIELD OF THE INVENTION

The present invention relates to an elongated LED lighting arrangement comprising various light wavelength-tuned components for increasing efficiency.

BACKGROUND OF THE INVENTION

Various elongated LED lighting arrangements for general illumination have been proposed in the prior art. Many of such arrangements suffer from low efficiency in conversion of electricity to light, and some arrangements produce light with a color temperature that may be less than pleasing to many viewers.

It would therefore be desirable to provide elongated LED lighting arrangements whose efficiency in converting electricity to useful light is enhanced, while having the capacity, if incorporated, of providing light with a desired color temperature.

BRIEF SUMMARY OF THE INVENTION

In a preferred form, an elongated LED lighting arrangement for emulating a tubular fluorescent lamp that provides useful general purpose illumination comprises an elongated fiberoptic light pipe extending between first and second ends. The light pipe has an exteriorly facing sidewall between the ends and comprises solid, homogeneous optical material between the ends. The light pipe is constructed to promote total internal reflection of some light between the first and second ends. A first LED light source comprises at least one LED tuned to efficiently provide light within a wavelength range to the light pipe, via the first end. Light-extracting means is applied to a length of the sidewall along the main path of TIR light propagation along the light pipe, and comprises down-converting means tuned to efficiently convert light rays from the LED light source within the wavelength range to lower-energy light rays at respectively longer wavelengths and light-scattering means for extracting from the light pipe some light rays within the wavelength range without changing the wavelengths of the foregoing light. The light-extracting means is arranged so that the light emitted by the down-converting means and the light-scattering means intermix to produce light, the majority of which has a composite color determined by the foregoing light emitted and the foregoing light extracted.

The foregoing elongated LED lighting arrangement beneficially has enhanced efficiency in converting electricity to useful light in comparison with many prior art arrangements, and also has the capacity, if incorporated, of providing light with a desired color temperature.

BRIEF DESCRIPTION OF THE DRAWINGS

Further features and advantages of the invention will become apparent from reading the following detailed description in conjunction with the following drawings, in which like reference numbers refer to like parts unless otherwise noted.

DETAILED DESCRIPTION OF PREFERRED EMBODIMENTS

Following the discussion of general principles of preferred embodiments, this detailed description discusses tuning of LEDs and down-converting means to improve efficiency, light pipe construction and preferred light-scattering means.

General Principles of Preferred Embodiments

Figure 1:
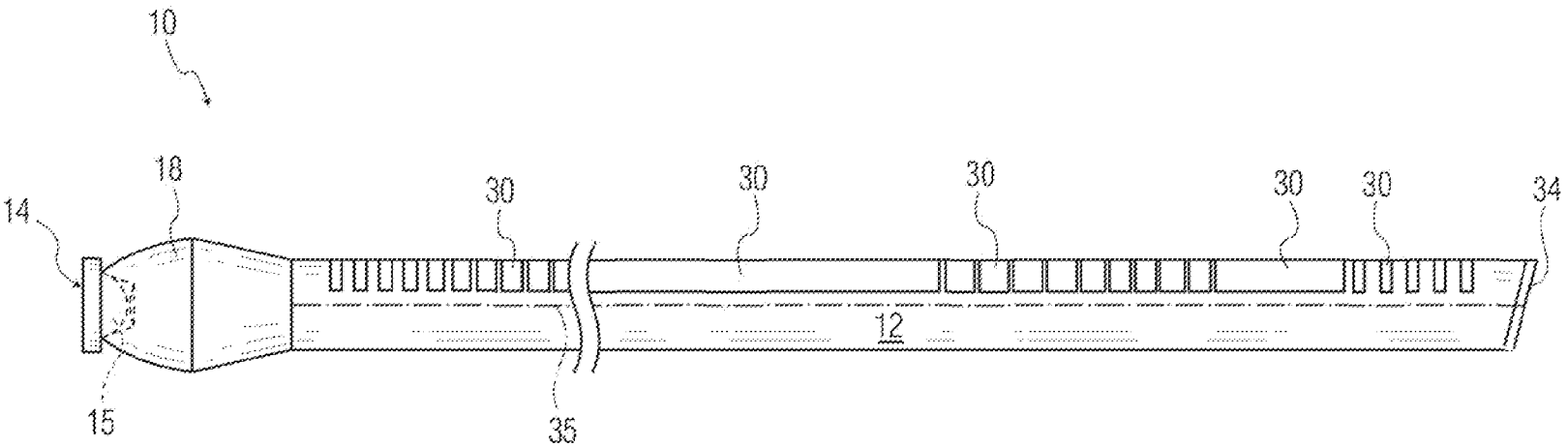
FIG. 1 is a diagrammatic side view of an elongated lighting arrangement in accordance with one embodiment of the invention.

FIG. 1 shows an elongated lighting arrangement 10 comprising a light pipe 12, which may comprise a cylindrical acrylic polymer rod, by way of example. Other details of suitable light pipes are described below. Light within a first wavelength range, preferably royal blue light, is provided to the left-shown end of light pipe 12 by light source 14, which comprises one or more LEDs preferably tuned to royal blue light. Royal blue light LEDs are presently preferred, because such LEDs are highly efficient in converting electricity to light. By "tuned" is meant herein that the component in question is designed in a way so as to enhance or even optimize some aspect of the "object" which is tuned, whereby, for instance, tuning of LEDs to royal blue light means that the LEDs are designed so as to enhance or even optimize royal blue light emission.

LED light source 14 comprises one or more LEDs for producing royal blue light, typically with a common lens 15.

A notch dichroic mirror (not shown) may be interposed between light source 14 and the left-shown end of light pipe 12, and tuned to pass more than 90 percent of light within the mentioned first wavelength range, and which preferably is for royal blue light. Such a dichroic mirror would serves the purpose of preventing royal blue light within the light pipe 12 from being wasted by being absorbed by the LED light source. However, the present inventors have experimentally verified that such a notch dichroic mirror may be omitted with a small, and typically negligible, loss of efficiency where the length of light pipe 12 bears the following relation to its maximum cross-sectional dimension: Where the length of the light pipe between its left-shown and right-shown ends is greater than ten (10) times the maximum cross-sectional dimension of the light pipe taken along the length of the light pipe 12 of FIG. 1 having an LED light source 14 at a single end, or in other words, where that length of the light pipe which is primarily illuminated by an LED light source at only one end of the light pipe is greater than ten (10) times the maximum cross-sectional dimension of the light pipe taken along its length. This beneficially removes the need for such a dichroic mirror when a light pipe conforms to the foregoing criterion.

Preferably interposed between LED light source 14 and light pipe 12 is a light coupler 18. Light coupler 18 is configured to condition the angular distribution of light to promote total internal reflection of such light within the light pipe. Light coupler 18 could be solid or hollow, could be of the imaging or non-imaging type, or a combination of the imaging and non-imaging type. Typically, a hollow reflector is of the imaging type to some extent.

Shown atop light pipe 12 is a light-extracting means 30, such as one or more phosphors, that include both down-converting and light-scattering means patterned to promote uniformity of light extraction along the length of the light pipe. The down-converting means can absorb light at one wavelength and emit longer-wavelength light at a lower energy; hence, the term "down-converting" means as used herein. Some material in a phosphor layer that is applied to a light pipe can act as light-scattering means, so as to extract light from the light pipe and emit it from a sidewall of the light pipe at the same wavelength. As used herein, "light-scattering means" or variants indicate the foregoing type of light extracting means without changing the wavelength of light.

At the right-shown end of light pipe 12 is a reflector 34 for capturing and returning to the left in FIG. 1 light from LED light source 14 that has not been extracted on a first pass through the light pipe. The reflector 34 is angled upwardly, with respect to a main axis 35 of totally internal reflection (TIR) light propagation through the light pipe 12, so as to increase the changes for the so-captured and returned light to interact with the light-extracting means 30 and be extracted from the light pipe.

Figure 2:
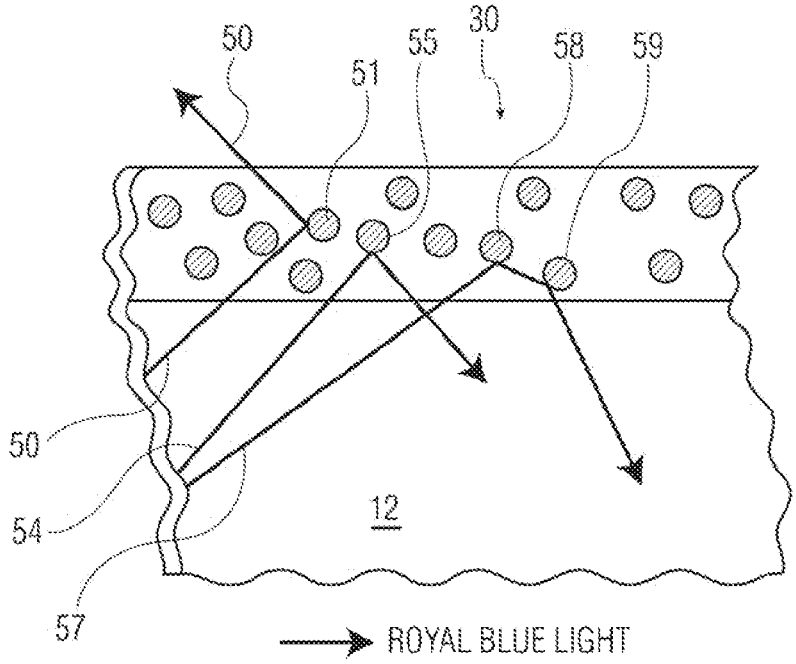
FIGS. 2 and 3 are enlarged, detail views of a light-extracting means atop a portion of the light pipe of FIG. 1
Figure 3:
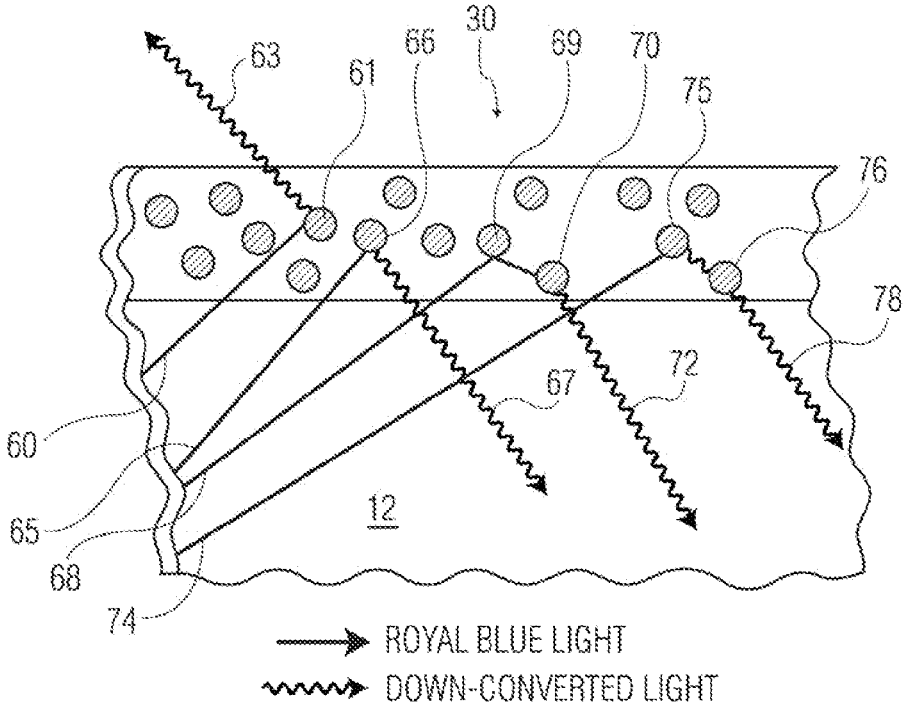

FIGS. 2 and 3 illustrate examples of the down-converting and light-scattering aspects of one or more phosphors mentioned in the foregoing paragraph. Thus, FIGS. 2 and 3 show light-extracting means 30 atop light pipe 12.

FIG. 2 illustrates light rays that are scattered by light-scattering means in the light-extracting means 30. In FIG. 2, royal blue light ray 50 strikes a light-scattering particle 51 in light-extracting means 30 and is reflected upwardly and out of the light pipe. Royal blue light ray 54 strikes a light-scattering particle 55 in light-extracting means 30 and is reflected downwardly and out of the light pipe due to having an angle that exceeds the critical angle from the longitudinal axis of light pipe 12 below which light rays will totally internally reflect (TIR) within the light pipe along the length of the light pipe. Finally, royal blue light ray 57 strikes a first light-scattering particle 58, which reflects the light ray to a second light-scattering particle 59 before being directed downwardly and outside the light pipe because it has a high angle as just explained with respect to light ray 54.

FIG. 3 illustrates light rays that are absorbed by down-converting means in the light-extracting means 30, which is what happens to most of the light rays that reach the light-extracting means 30 of FIG. 1 in contrast to the light-scattering just described in relation to FIG. 2. In FIG. 3, royal blue light ray 60 is absorbed by a down-converting particle 61, and longer-wavelength down-converted light 63 is emitted upwardly. A royal blue light ray 65 is absorbed by down-converting particle 66 and a lower-energy down-converted light ray 67 is emitted downwardly and out of the light pipe due to having an angle that exceeds the critical angle from the longitudinal axis of light pipe 12 below which light rays will totally internally reflect (TIR) within the light pipe along the length of the light pipe. A royal blue light ray 68 strikes a light-scattering particle 69 and is reflected to down-converting particle 70, which absorbs light ray 68 and emits lower-energy down converted light ray 72 downwardly and out of the light pipe because it has a high angle as just explained with respect to light ray 67. Finally, royal blue light ray 74 is absorbed by down-converting particle 75, which emits down-converted light 78 that strikes light scattering particle 76 and is reflected downwardly and out of the light pipe because it has a high angle as explained above in this paragraph with respect to light ray 67.

Figure 4:
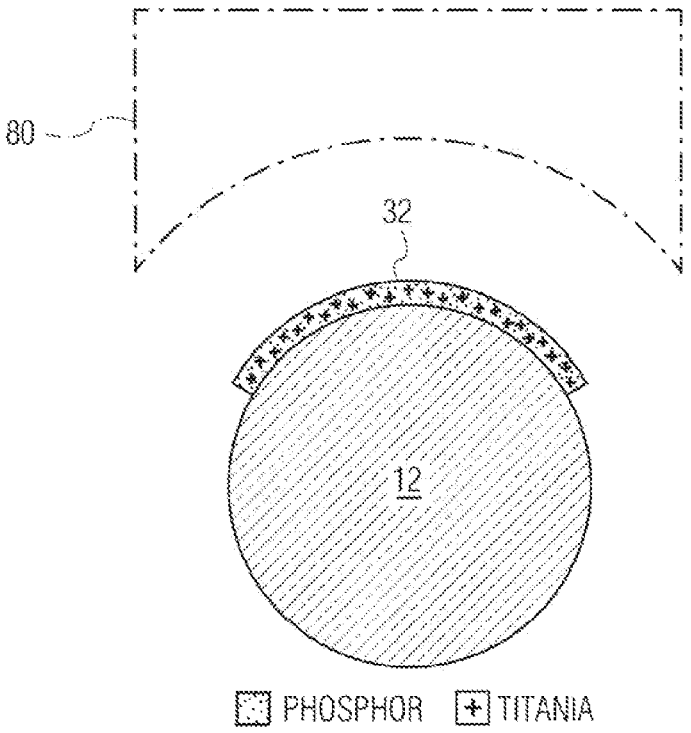
FIGS. 4 and 5 are enlarged cross sectional views taken along the main axis of the lighting arrangement of FIG. 1.
Figure 5:
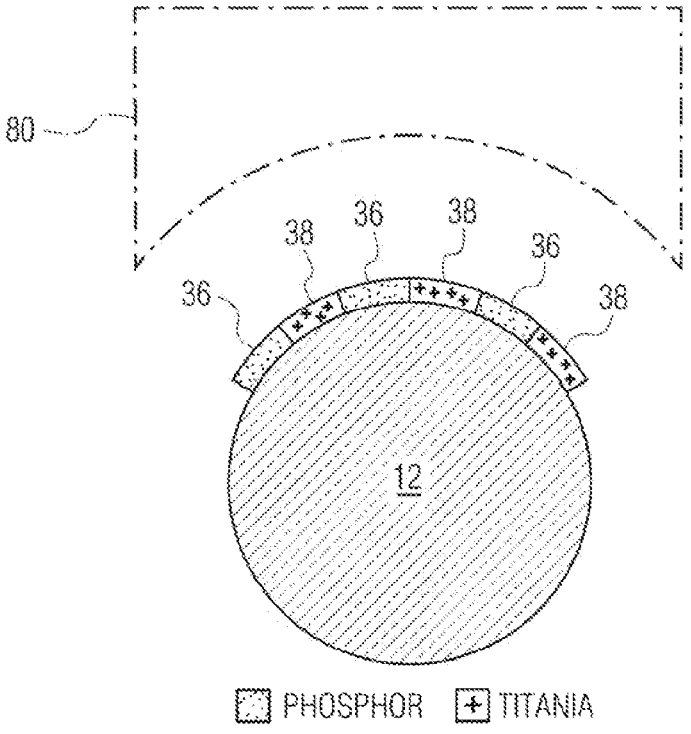

The lighting arrangement 10 of FIG. 1 preferably achieves a desired composite color temperature of light. Intermixture of the exemplary, partially shown light rays of FIGS. 2 and 3, such as respective light rays 54 and 57 in FIG. 2, and respective down-converted light rays, such as 67, 72, and 78 in FIG. 3, occurs inside of light pipe 12. However, mixing of light of various colors may occur in other places as well, including regions (not shown) outside of light pipe 12. Preferably, the majority of (and more preferably more than 90 percent of) light produced by lighting arrangement 10 results in a composite color determined by the intermixture of scattered light and down-converted light. In regard to obtaining a composite color of light, acrylic that may be used to form the light pipe 12 may itself absorb (and thus waste) a small amount of light depending on the wavelength of light. Such absorbed light will be unable to contribute to the composite color temperature of light.

Where a greater extent of extraction of light from the sidewall of light pipe 12 of FIG. 1 at the same wavelength is desired, the light-extracting means 30 of FIG. 1 can also incorporate more traditional light-scattering material. Thus, FIGS. 4 and 5 show the incorporation of titania, as indicated by the small x-shaped particles to contrast with dots used to portray phosphor. FIG. 4 shows titania and phosphor intermixed in light-extracting means 32, whereas FIG. 5 shows one example of stripes 36 of a light-extracting means comprising phosphor and interspersed stripes 38 of titania, which would each have a suitable binder, and could be oriented in other directions than along the main path of light propagation from end to end of light pipe 12.

In FIGS. 4 and 5, a typically non-specular reflector 80 can capture light that is directed upwardly (e.g., light rays 50 and 63 in FIGS. 2 and 3, respectively) and redirect such light back downwardly. As an alternative to a separate reflector 80, a further layer (not shown) of light-scattering material (e.g., titania) can be added atop the light-extracting means 32 in FIG. 4 or the interdigitated phosphor 36 and titania 38 layers in FIG. 5. The need for a reflector increases when the light-extracting means is applied in a relatively thin layer; and, conversely, the need for a reflector decreases when the light-extracting means is applied in a relatively thick layer. Such a further layer of light-scattering material is shown in phantom at 86 in FIG. 6, which layer 86 is applied atop light-extracting means 82 and 84.

In FIGS. 4 and 5, the thickness of the layers of light-extracting means 32 and 38 and layer of phosphor 36 has a bearing on how much light passes through such means 32 or 38 and phosphor 36. Reducing the thickness of such layers increases the amount of light that can pass entirely through such layers and reach the reflector 80, rather than being sent directly to a target area (not shown) for illumination. Typically, the layers of means 32 and 38 and phosphor 36 can be configured (i.e., made thinner) so as to allow greater than 25 percent of the light to reach reflector 80, and such percentage can easily be made higher (e.g., greater than 40 percent).

Alternatives to a light-extracting means comprising one or more phosphors are quantum dots or dyes, for instance; and alternatives to titania as a light-scattering means will be routine to those of ordinary skill in the art.

Figure 6:
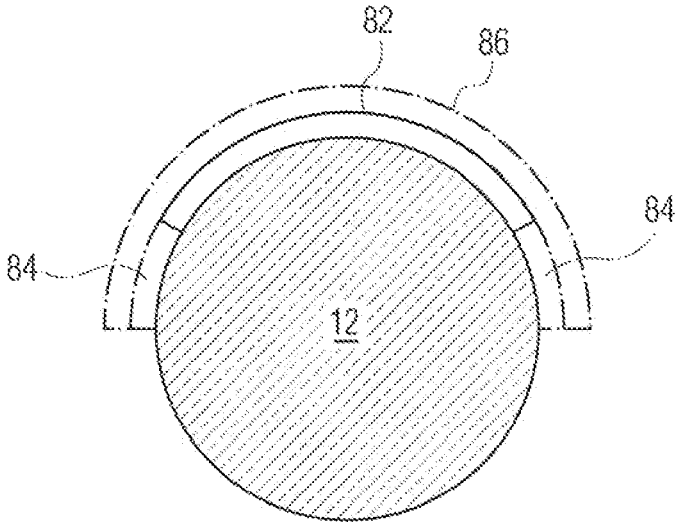
FIG. 6 is a diagrammatic view of a further cross sectional view taken along the main axis of the lighting arrangement of FIG. 1.

FIG. 6 shows a light-extracting means 82 having atypical a circumferential swath of the light pipe 12 around a main axis (as viewed in FIG. 1) of approximately 120 degrees, as shown. In some installations, a typical circumferential swath of the light-extracting means 82 and optional further portions 84 of the light-extracting means around the light pipe 12 is approximately 180 degrees, as shown. Many variations from the foregoing exemplary swaths will occur to persons of ordinary skill in the art.

Figure 7:
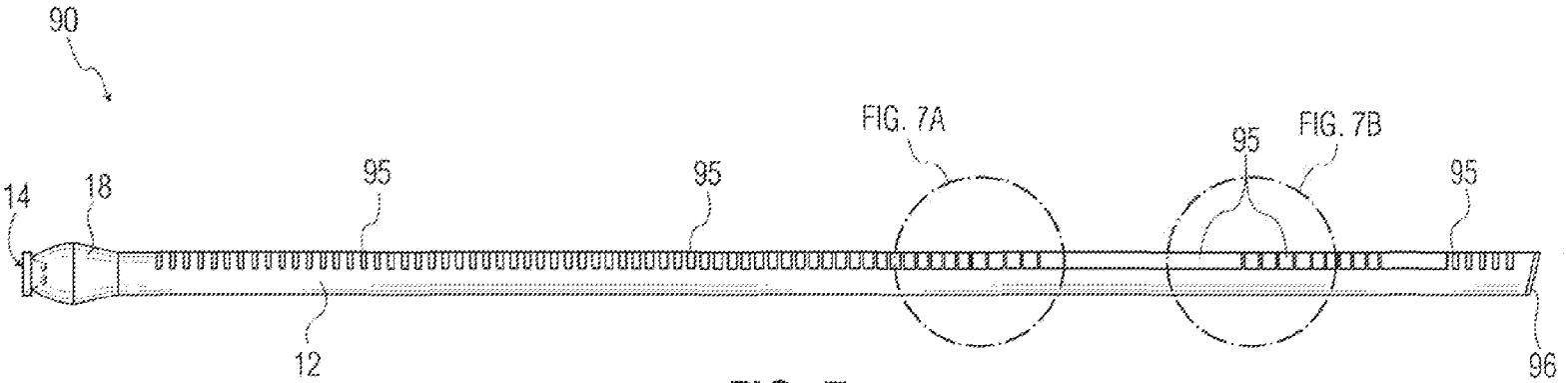
FIG. 7 is a side view of an elongated lighting arrangement similar to that of FIG. 1, but drawn to scale.
Figure 8:
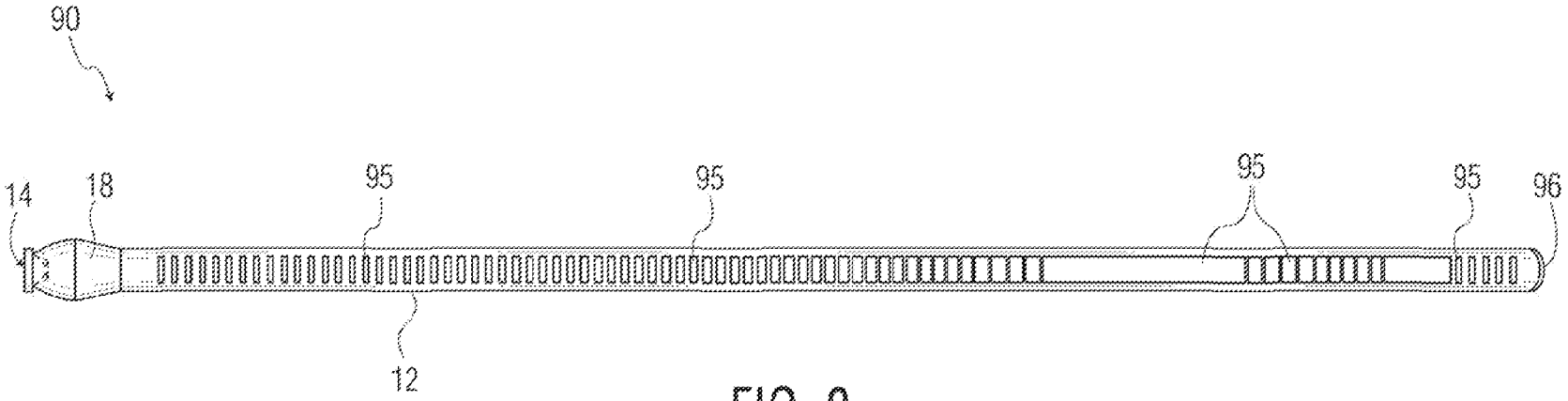
FIG. 8 is a top view of the elongated lighting arrangement of FIG. 7, also drawn to scale.

FIGS. 7 and 8 show elongated lighting arrangement 90 with light pipe 12 and light-extracting means 95, comparable to light-extracting means 30 of FIG. 1, drawn to scale. A reflector 96 is used at the right-shown end of light pipe 12 for capturing and reflecting to the left light in the same manner as reflector 34 of FIG. 1, as described above.

Figure 7A:
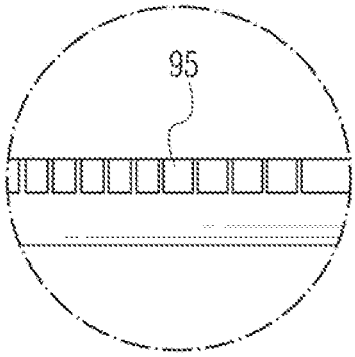
FIGS. 7A and 7B are enlarged views of portions of the light pipe of FIG. 7.
Figure 7B:
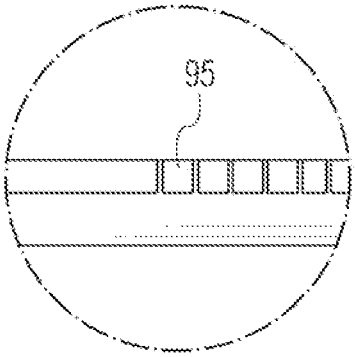

FIGS. 7A and 7B show enlarged, exemplary portions of light pipe 12 from FIG. 7. Light-extracting means 95, also illustrated in FIG. 7, are also comparable to light-extracting means 30 of FIG. 1.

Although the following U.S. patents teach patterns of light-scattering means, as defined above, and not patterns of light-extracting means, as defined above, that include down-converting means, the present inventors have determined that such patterns may be beneficially used for light-extracting means (e.g., 95 in FIGS. 7 and 8) that include down-converting means: U.S. Pat. No. 7,163,326 B2 issued in Jan. 16, 2007, entitled "Efficient Luminaire with Directional Side-Light Extraction" and U.S. Pat. No. 7,374,313 B2 issued on May 20, 2008, entitled "Luminaire with Improved Lateral Illuminance Control," the full disclosures of which are incorporated herein by reference.

The patterning of light-extracting means 95 along the length of light pipe 12 of FIGS. 7 and 8 is preferably done in accordance with the teachings in the foregoing U.S. Pat. No. 7,163,326 B2, so that illuminance over each sequential 10 percent length of the light-extracting means is uniform to within 25 percent of the average illuminance along the length of the luminaire, as defined below, where illuminance is measured orthogonally to the main path of TIR light propagation along the light pipe (comparable to main path 35 in FIG. 1) and is measured at an angle relative to such main path at which illuminance is a maximum. Luminaire connotes herein the portion of a light pipe in which light is extracted from the side of the light pipe.

The use of the patterns taught in the mentioned U.S. Pat. No. 7,163,326 B2 achieves an efficient conversion of electricity into light, while maintaining a uniform appearance of light along the length of the light pipe. This is without the need for bulky and complex reflectors required for fluorescent lamps, and many embodiments can provide the same usefully directed light output of a fluorescent lamp at about half or less electrical power than required for such fluorescent lamp.

It may further be desirable to pattern light-extracting means 95 over a circumferential swath of the light pipe 12 (e.g., 120 degrees of swath) wherein the swath, measured orthogonal to the mentioned main path of TIR light propagation through light pipe 12 has a non-uniform light-extraction efficiency along the swath. This may be desirable to soften the edges of the resulting light distribution, parallel to the light pipe, by way of example; or, to make the light distribution more uniform between such edges.

Figure 9:
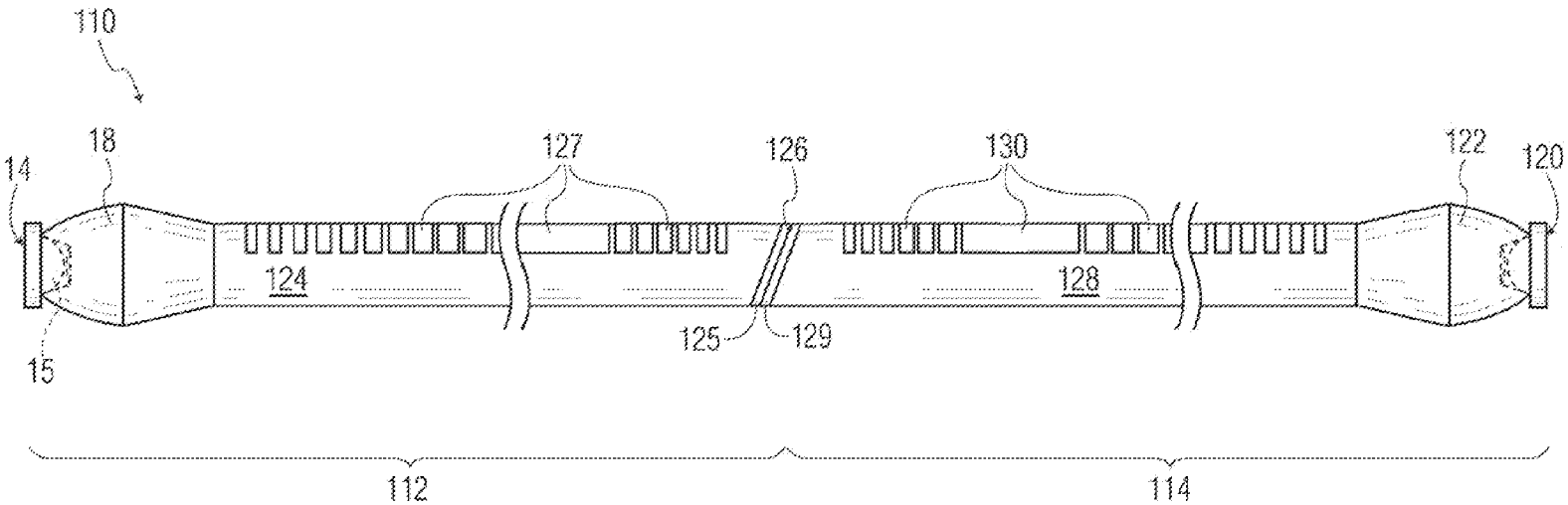
FIGS. 9 and 10 are diagrammatic views similar to FIG. 1, but show alternative embodiments of the invention.

As an alternative to elongated lighting arrangement 10 of FIG. 1, FIG. 9 shows an elongated lighting arrangement 110, which contains two opposing portions 112 and 114, each of which is similar to lighting arrangement 10. Thus, opposing portions 112 and 114 respectively have similar LED light sources 14 and 120 and light couplers 18 and 122, similar light pipes 124 and 128 and terminating reflectors 125 and 129 acting like reflector 34 of FIG. 1, and similar light-extracting means 127 and 130 acting like light-extracting means 30 of FIG. 1 and 95 of FIGS. 7 and 8. Terminating reflectors may have different orientations, such as, for instance, being approximately parallel to each other, as shown in FIG. 9.

Junction 126, which joins light pipe portion 112 to light pipe portion 114 and respective reflector 125 to reflector 129, may be structurally reinforced by such methods as a mechanical stabilizer, for example a bracket (not shown), or an adhesive material such as a glue. With this configuration, various sizes of light pipes may be formed. For instance, if light pipe portion 112 is approximately four feet (1.2 meters) in length, and light portion 114 is approximately four feet in length (1.2 meters), once joined and stabilized, elongated lighting arrangement 110 may measure approximately eight feet (2.4 meters) in length. Such versatility in the sizing of elongated lighting arrangement 110 permits, for example, matching lengths of lighting arrangements with lengths of existing lighting fixtures.

In the alternative embodiment of FIG. 9, a single power supply may power both of the LED light sources 14 and 120, where the LED light sources are connected in electrical series, rather than two smaller power supplies for respectively supplying the light sources. The use of a single power supply beneficially reduces the cost of providing power to the elongated lighting arrangement 110, since a single, larger power supply is only marginally more expensive than a single, smaller power supply. In addition, it is more efficient for the larger power supply to reduce voltage from the power mains voltage (e.g., 277 volts) to 24 volts, for instance, where each LED light source requires 12 volts, rather than to reduce voltage from the power mains voltage (e.g., 277 volts) to 12 volts, for instance.

Figure 10:
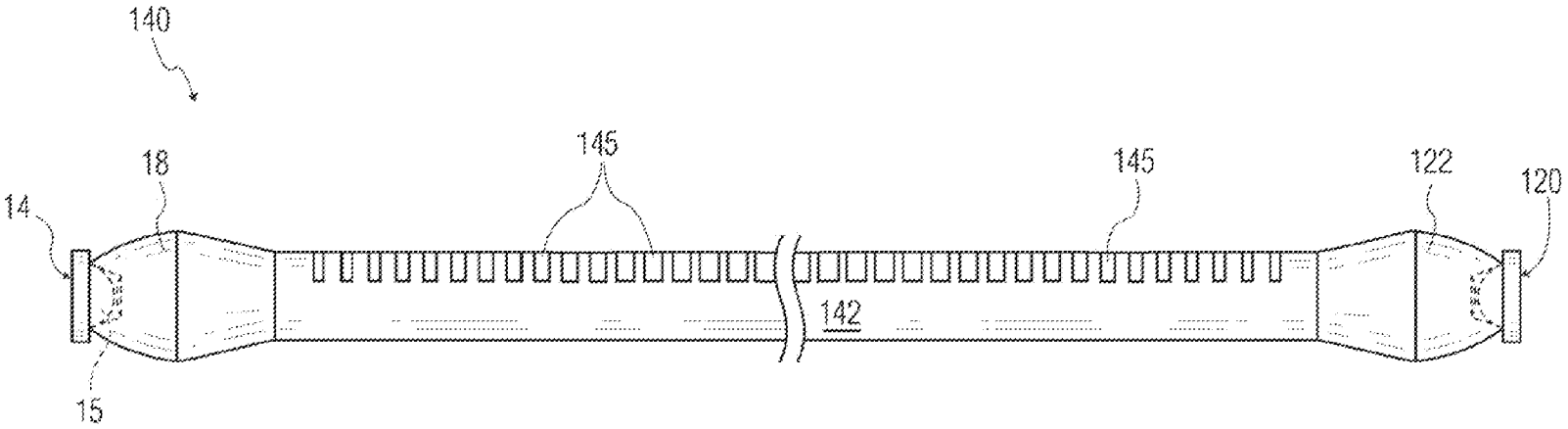

FIG. 10 shows a further alternative to elongated lighting arrangement 10 of FIG. 1, wherein elongated lighting arrangement 140, with a light pipe 142 (similar to light pipe 12 of FIG. 1) and light-extracting means 145 (generally similar to light-extracting means 30 of FIG. 1), has an LED light source 120 and light coupler 122 (similar to LED light source 14 and light coupler 18 of FIG. 1) at the right-shown end. Though generally similar to light-extracting means 30 of FIG. 1, light-extracting means 145 would typically have its light-extraction efficiency more symmetrically arranged between LED light sources 14 and 120 than light-extracting means 30 of FIG. 1. This is because light source 120 in FIG. 10 would typically direct more light to the left than would reflector 34 of FIG. 1. In this configuration, LED light source 14 does not need to provide sufficient light to illuminate the entire pipe, and longer elongated lighting arrangements may be used.

Tuning of LEDs and Down-Converting Means to Improve Efficiency

In conformity with the above definition of "tuned," the word "tuning" means herein that a component in question is designed in a way so as to enhance or even optimize some aspect of the "object" which is tuned, whereby, for instance, tuning of LEDs to royal blue light means that the LEDs are designed so as to enhance or even optimize royal blue light emission. Such designing (or tuning) is done before manufacturing a component. More description is now provided for of tuning components such as the LEDs used in the various light sources 14 and 120, and the down-converting means of light-extracting means 30, 95, 127, 130 and 145, in order to improve the overall efficiency of conversion of electricity to light. The overall efficiency is depends on the efficiencies of various processes, discussed below.

As mentioned above, the LEDs of light sources, such as those numbered 14 (FIG. 1) and 120 (FIGS. 9 and 10) are preferably tuned to efficiently convert electricity to light. With presently available LEDs, maximum efficiency has been attained converting electricity to royal blue light, typically in the wavelength range from 420-500 um. This might be accomplished with an indium gallium nitride LED, for instance, which is direct bandgap material. Single crystal layers of such LEDs presently exhibit up to about 60 percent conversion efficiency from electricity to photons. It is preferred that the LED light source produce light with a wavelength above about 400 nm, so as to avoid shorter wavelength, higher energy light (such as ultraviolet) that can be damaging to persons and materials. This allows the use of light pipes (e.g., 12, FIG. 1) made of acrylic, for instance, that would become optically degraded from exposure to higher energy (shorter wavelength) light.

Figure 11:
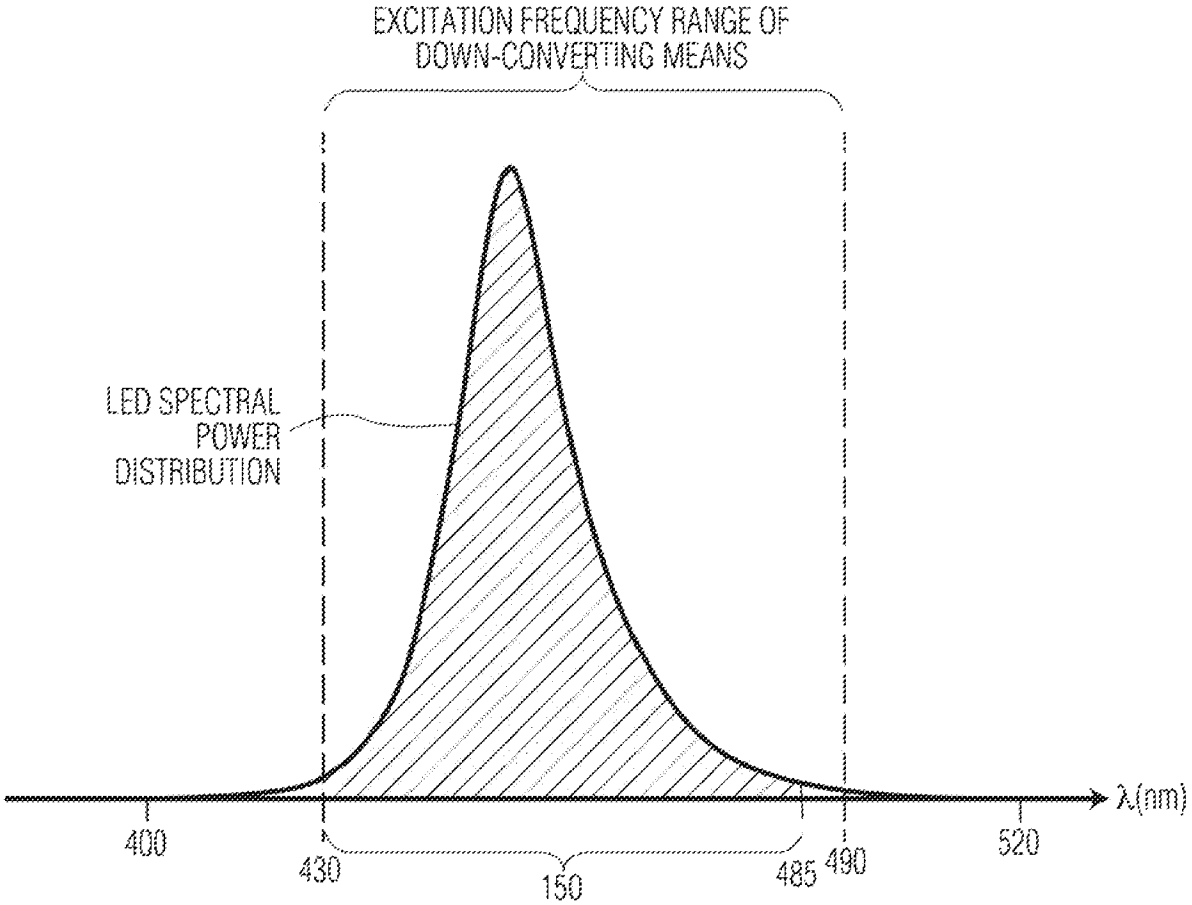
FIG. 11 shows in graph form typical wavelength characteristics of LEDs.

FIG. 11 helps explain "tuning" characteristics for the mentioned royal blue LEDs and down-converting means of light-extracting means (e.g., 30, 95, 127, 130 and 145), by showing typical wavelength characteristics for the foregoing components.

In FIG. 11, exemplary LED Spectral Power Distribution extends from about 400 nm to about 520 nm, but more than 95 percent of its spectral range typically falls within a range 150 extending from about 430 nm to about 485 nm. A preferred LED may be those sold by Cree, Inc. of Durham, N.C. USA, under Product Code XLamp XT-E Royal Blue LEDs. Beneficially, the illustrated, typical Excitation Wavelength Range of Down-Converting Means includes the foregoing wavelength range 150. An exemplary light-extracting means including a down-converting means comprises a phosphor sold by Internatix of Fremont, Calif., USA, under Product Code NYAG4653, by way of example. Accordingly, the royal blue light from the LEDs can be efficiently converted to another color spectrum, such as white, by the down-converting means.

Figure 12:
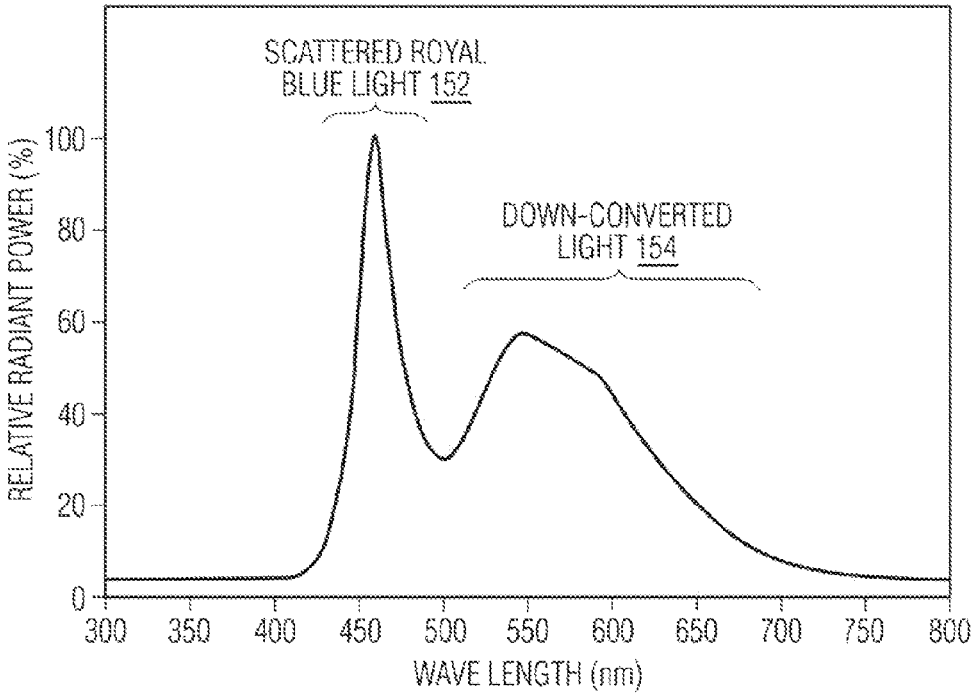
FIG. 12 shows in graph form typical wavelength characteristics of royal blue scattered light and down-converted light produced by an elongated LED lighting arrangement in accordance with the invention.

FIG. 12 shows a typical spectrum of white light that can be produced from an elongated LED lighting arrangement (e.g., 10, FIG. 1). Preferably, about 5 percent (or at least about 3 percent) of the royal blue light that exits an elongated LED lighting arrangement 10 is scattered from the light pipe (e.g., 12, FIG. 1) by the above-described light-scattering means, and is shown as scattered royal blue light 152 in FIG. 12. Preferably, the down-converted light that exits the light pipe, and is shown as down-converted light 154 in FIG. 12, is sufficiently close in wavelength to the royal blue light produced by the LED light source (as shown in FIG. 11, for instance), so as to reduce the so-called Stokes Shift energy loss to less than about 30 percent, or at least less than about 40 percent. In the wavelength range between scattered royal blue light 152 and down-converted light 154, as for example at 500 nm, the light may be either scattered royal blue light or down-converted light. In this example, the LED light source may be indium-gallium-nitride, and the down-converting means may be a $Ce^{+3}$:YAG phosphor, where YAG is yttrium-aluminum-garnet.

The Stokes Shift energy loss is the energy lost when a royal blue photon, for instance, is absorbed in a down-converting means and then reemitted at a lower energy (and longer wavelength). By reducing the Stokes Shift energy loss, not only is overall efficiency directly increased, but also the LED light sources operate at a cooler temperature, which reduces the amount of heat that needs to be removed from the LEDs.

A further factor that increases overall efficiency is the use of a light pipe (e.g., 12, FIG. 1) where the length of the light pipe bears the following relation to its maximum cross-sectional dimension: That length of the light pipe which is primarily illuminated by an LED light source at only one end of the light pipe is greater than ten (10) times the maximum cross-sectional dimension of the light pipe taken along its length. Because the light pipe is designed for nearly lossless TIR propagation of light along the length of the light pipe, the scattered royal blue light 152 in FIG. 12, for instance, has ample opportunities for mixing with down-converted light (e.g., 154 in FIG. 12) without incurring losses. In addition, light propagating along the light pipe has a very low probability of returning to its LED light source, where it would have a significant probability of being absorbed by the LED light source and being wasted. In the foregoing configuration of the light pipe, typically less than about 1 percent of light is returned to the LED light source, compared with as much as 50 percent in a conventional approach using phosphors applied directly to the LED light source. This has the additional beneficial effect of reducing heat in the proximity of the LED light source, which allows the LED light source to operate more efficiently.

The present section of the specification entitled, "Tuning of LEDs and Down-Converting Means to Improve Efficiency," describes various efficiencies, some related to the use of down-converting means, which contribute to an overall efficiency increase over prior art approaches. By using the various efficiencies, the present inventors estimate that the overall efficiency of conversion of electricity to white light can typically be increased by as much as 30 percent from prior art elongated LED lighting arrangements that use only light-scattering means for extracting light from a light pipe.

Chassis for Gripping and Protecting Illumination Portions of Lamp

Figure 13:
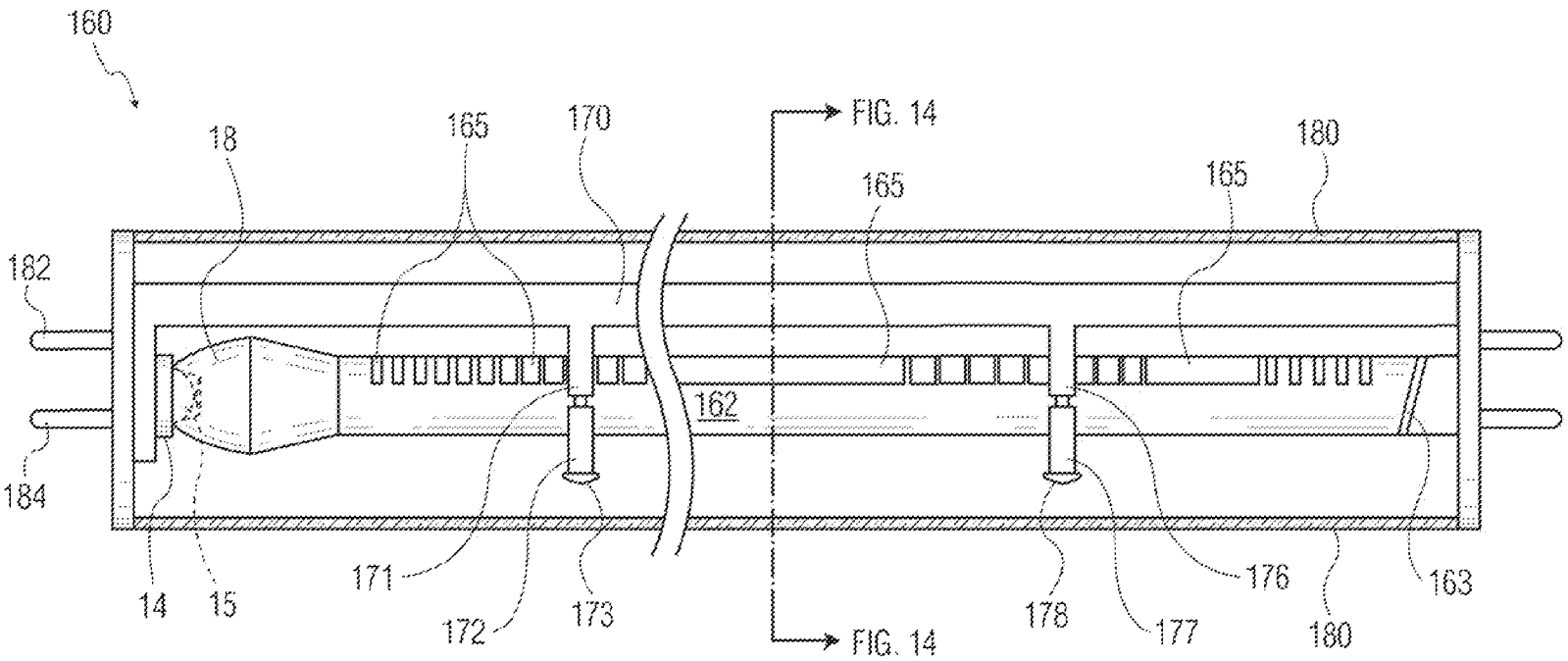
FIG. 13 is a diagrammatic view of an alternative embodiment of the elongated lighting arrangement of FIG. 1.

FIG. 13 shows a further alternative to elongated lighting arrangement 10 of FIG. 1, wherein elongated lighting arrangement 160 (similar to light pipe 12 of FIG. 1) includes a light pipe 162 (similar to light pipe 12 of FIG. 1) and light-extracting means 165 (generally similar to light-extracting means 30 of FIG. 1), has an LED light source 14 and light coupler 18, and wherein light pipe 162 underlies and is preferably supported by a chassis 170 via downwardly depending bracket portions 171, 172, 176 and 177. One pair of bolts, only one bolt 173 of which is shown in FIG. 12, joins upper bracket portion 171 to lower bracket portion 172 and another pair of bolts, only one bolt 178 of which is shown in FIG. 13, joins upper bracket portion 176 to lower bracket portion 177. Chassis 170 and its brackets 171, 172, 176 and 177 preferably are formed of the following commonly used metals or plastics or metal-filled plastics: (1) an injection moldable or extrudable metal such as aluminum or zinc or (2) a resilient, injection moldable, or extrudable plastic material such TERLURAN-brand ABS (acrylonitrile/butadiene/styrene) resin from BASF USA of Florham Park, N.J., USA or DELRIN-brand acetal resin from E.I. Du Pont De Nemours and Company of Wilmington, Del., USA, or (3) Polyamide and polystyrene, available as injection-moldable resins from Cool Polymers, Inc., Headquarters, R&D, and Mfg., North Kingstown, R.I. USA. Chassis 170 can act also as a heat sink for electronic components (not shown) stored in the interior volume (not shown) of chassis 170, especially when composed of aluminum, zinc or another metal-filled polymer such as polyamide and polystyrene, available as injection-moldable resins from Cool Polymers, Inc., Headquarters, R&D, and Mfg., North Kingstown, R.I. USA.

A reflector 163 is used at the right-shown end of light pipe 162 for capturing and reflecting to the left light in the same manner as reflector 34 of FIG. 1, as described above.

LED light source 14 preferably comprises one or more LEDs, all of which are provided with (i) a single pair of power leads (not shown) connected to respective pairs of electrode pins 182 and 184, (ii) a printed-circuit board, and (iii) a single lens 15 for conditioning light output.

Chassis 170 provides strength for elongated lighting arrangement 160, while providing material suitable for gripping, in the absence of a covering such as a transparent protective tube 180 by a user when installing, adjusting or removing the elongated lighting arrangement 160 from a fluorescent light fixture (not shown). Transparent protective tube 180 may be made of, for instance, polycarbonate. Moreover, chassis 170 can incorporate aesthetic features, such as colors, shapes and decorative or other distinctive features.

Chassis 170 preferably is mounted to a fluorescent lamp fixture (not shown) by electrode pins 182 and 184. However, chassis 170 can be further secured to a fluorescent lamp fixture (not shown) by screws, magnets, or sturdy prongs, at each end of the chassis, in addition, or as an alternative to, the use of electrode pins 182 and 184.

On-Board Storage of Electrical Circuits, Etc.

Figure 14:
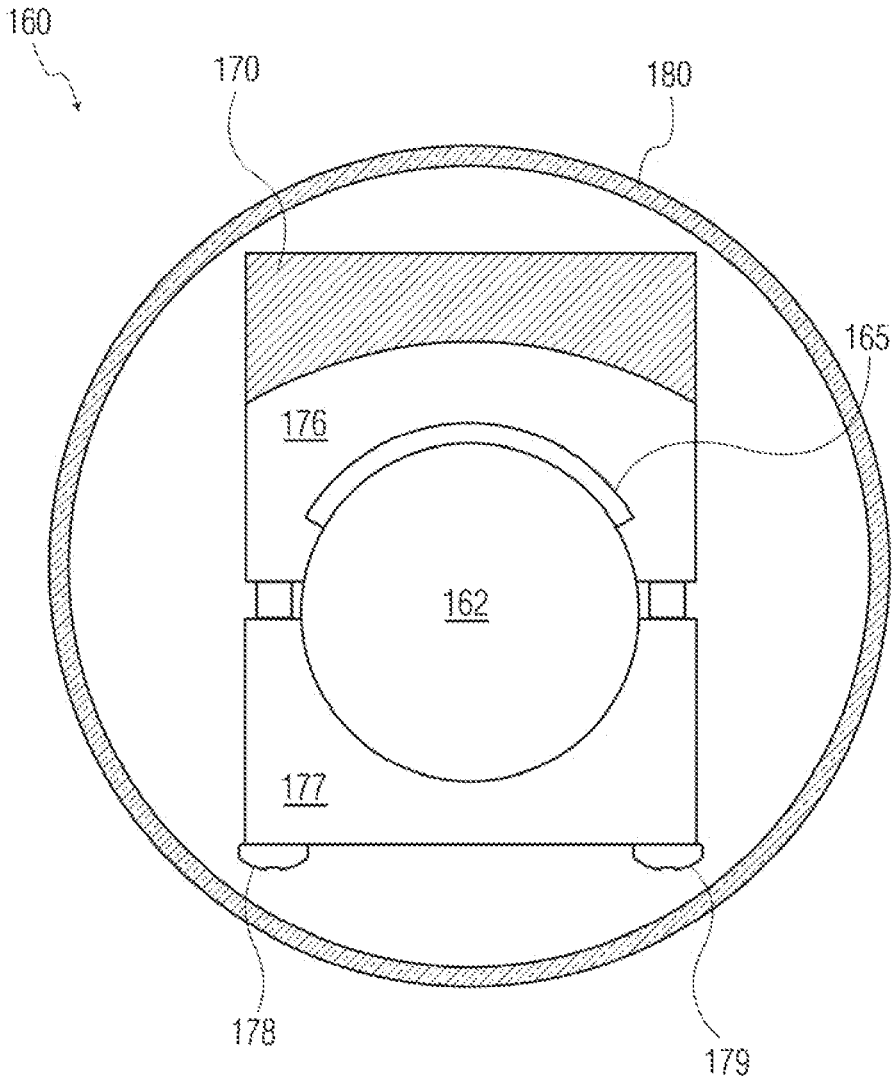
FIG. 14 is a simplified cross-sectional view of the elongated lighting arrangement of FIG. 13.

FIG. 14 is a cross-section of taken along a length of elongated lighting arrangement 160 of FIG. 13. A protective tube 180, corresponding to protective tube 180 of FIG. 13, protects components within the tube, for example light pipe 162. Chassis 170 supports light pipe 162 via downwardly depending brackets 176 and 177, for example, and a pair of bolts 178 and 179 join upper bracket portion 176 to lower bracket portion 177.

A cavity (not shown) in chassis 170 may contain other electric circuits in the interior volume of chassis 170, such as printed-circuit boards ballasts, drivers, communication devices, wireless radio devices, sensors, controllers or any other device that can enhance the performance of LED elongated lighting arrangement 160. For instance, a wireless radio device (not shown) stored in chassis 170 may be responsive to an occupancy sensor, for instance, so as to turn down or off LED light sources when an illuminated space is not occupied by a person. Further, for instance, a controller (not shown) stored in chassis 170 may consist of circuitry to allow for dimming of lights, turning off a LED sources individually if there is one or more LED source at each end of the lamp, or dimming one or the other LED light sources at the ends especially if the LED light sources have different color or efficiency qualities.

Light Pipe Construction

The light pipe preferably comprises an elongated member, which may be in the form of a solid or hollow rod. By "elongated" is meant being long in relation to width or diameter, for instance, where the "long" dimension can be both along a straight path or a curved path. At least one end of the light pipe receives light from an associated light coupler. The elongated member has an elongated sidewall and light-extracting means along at least part of the elongated sidewall for extracting light through the sidewall and distributing said light to a target area. At least that portion of the light pipe having light-extracting means is preferably solid, although there may exist in the pipe small voids caused by manufacturing processes, for instance, that have an insubstantial impact on the side-light light extraction and distribution properties of the pipe.

A light pipe, which preferably comprises a fiberoptic light pipe, may comprise an acrylic polymer rod, or high-temperature glass or quartz for operation in a heated environment, or other optically clear material such as the core of a large core, flexible, plastic, fiberoptic light pipe.

A fiberoptic light pipe may, for instance, have the configuration of a straight rod or the configuration of a fiber of a loop shape with the two ends of the fiber close to each other. As will be known in the art, the bend angles of a light pipe in a looped configuration affect TIR properties of light passing along the length of the light pipe. As used herein, the term "fiberoptic light pipe" connotes a light pipe in which the minimum cross-sectional dimension of the fiber is more than 25 percent of the maximum cross-sectional dimension of the fiber. In a preferred embodiment, the cross-section of the rod is substantially circular.

Preferably, a light pipe is rigid, by which is meant that at 20 degrees Celsius the pipe has a self-supporting shape such that the pipe returns to its original or approximately original (e.g., linear or curved) shape after being bent along a central path of light propagation through the pipe.

Light-Scattering Means

Light-scattering means that may be used in conjunction with light-extracting means, as shown, for instance, in FIGS. 4 and 5, may be of various types whose selection will be routine to those of ordinary skill in the art. For instance, three types of light-scattering means are disclosed in U.S. Pat. No. 7,163,326, entitled "Efficient Luminaire with Directional Side-Light Extraction," assigned to Energy Focus, Inc. of Solon, Ohio. In brief, these three types are (1) discontinuities on the surface of a light pipe, (2) a layer of paint on the surface of a light pipe, and (3) a vinyl sticker applied to the surface of a light pipe.

In more detail, (1) discontinuities on the surface of a light pipe may be formed, for instance, by creating a textured pattern on the light pipe surface by molding, by roughening the light pipe surface with chemical etchant, or by making one or more indentations in the side of the light pipe. Secondly, (2) the light-scattering means could comprise a layer of paint exhibiting Lambertian-scattering and having a binder with a refractive index about the same as, or greater than that of, the core. Suitable light-scattering particles are added to the paint, such as titanium dioxide or many other materials as will be apparent to those of ordinary skill in the art. Preferably, the paint is an organic solvent-based paint. Thirdly, (3) the light-scattering means could comprise vinyl sticker material in a desired shape applied to the surface of the light pipe. Appropriate vinyl stickers have been supplied by Avery Graphics, a division of Avery Dennison of Pasadena, Calif. The film is an adhesive white vinyl film of 0.146 mm thickness, typically used for backlit signs.

Generally, the light-scattering means may be continuous or intermittent or partially continuous and partially intermittent along the length of a light pipe, for instance. An intermittent pattern is shown in the above-mentioned U.S. Pat. No. 7,163,326 in FIG. 15A, for instance. To assure that the light-scattering means appears as continuous from the point The following is a list of reference numerals and associated parts as used in this specification and drawings:

| Reference Numeral | Part |
|---|---|
| 10 | Elongated lighting arrangement |
| 12 | Light pipe |
| 14 | LED light source |
| 15 | Lens |
| 18 | Light coupler |
| 30 | Light-extracting means |
| 32 | Light-extracting means |
| 34 | Reflector |
| 35 | Main axis of TIR light propagation |
| 36 | Phosphor |
| 38 | Titania |
| 50 | Royal blue light ray |
| 51 | Light-scattering particle |
| 54 | Royal blue light ray |
| 55 | Light-scattering particle |
| 57 | Royal blue light ray |
| 58 | Light-scattering particle |
| 59 | Light-scattering particle |
| 60 | Royal blue light ray |
| 61 | Down-converting particle |
| 63 | Down-converted light ray |
| 65 | Royal blue light ray |
| 66 | Light-scattering particle |
| 67 | Down-converted light ray |
| 68 | Royal blue light ray |
| 69 | Light-scattering particle |
| 70 | Down-converting particle |
| 72 | Down-converted light ray |
| 74 | Royal blue light ray |
| 75 | Down-converting particle |
| 76 | Light-scattering particle |
| 80 | Reflector |
| 82 | Light-extracting means |
| 84 | Light-extracting means |
| 86 | Light-scattering means |
| 90 | Elongated lighting arrangement |
| 94 | Light-extracting means |
| 95 | Reflector |
| 110 | Elongated lighting arrangement |
| 112 | Symmetrical portion |
| 114 | Symmetrical portion |
| 120 | LED light source |
| 122 | Light coupler |
| 124 | Light pipe |
| 125 | Reflector |
| 126 | Junction |
| 127 | Light-extracting means |
| 128 | Light pipe |
| 129 | Reflector |
| 130 | Light-extracting means |
| 140 | Elongated lighting arrangement |
| 142 | Light pipe |
| 145 | Light-extracting means |
| 150 | Range |
| 152 | Scattered royal blue light |
| 154 | Down-converted light |
| 160 | Elongated lighting arrangement |
| 162 | Light pipe |
| 163 | Reflector |
| 165 | Light-extracting means |
| 170 | Chassis |
| 171 | Bracket portion |
| 172 | Bracket portion |
| 173 | Bolt |
| 176 | Bracket portion |
| 177 | Bracket portion |
| 178 | Bolt |
| 179 | Bolt |
| 180 | Transparent protective tube |
| 182 | Electrode pins |
| 184 | Electrode pins |

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. An elongated LED lighting arrangement for emulating a tubular fluorescent lamp that provides useful general purpose illumination, comprising:

a) an elongated fiberoptic light pipe extending between first and second ends; the light pipe having an exteriorly facing sidewall between said ends; the light pipe comprising solid, homogeneous optical material between said ends and being constructed to promote total internal reflection of some light between the first and second ends;

b) a first LED light source comprising at least one LED tuned to efficiently provide light within a wavelength range to the light pipe, via said first end;

c) light-extracting means applied to a length of said sidewall along a main path of TIR light propagation along the light pipe; the light-extracting means comprising:

i) down-converting means tuned to efficiently convert light rays from said LED light source within said wavelength range to lower-energy light rays at respectively longer wavelengths; and ii) light-scattering means for extracting from the light pipe some light rays within said wavelength range without changing the wavelengths of the foregoing light; and d) the light-extracting means being arranged so that the light emitted by the down-converting means and the light-scattering means intermix to produce light, the majority of which has a composite color determined by the foregoing light emitted and the foregoing light extracted.

2. The lighting arrangement of claim 1, wherein:

a) said composite color is white;

b) more than 90 percent of the light within said wavelength range of the first LED light source has a wavelength longer than 400 nm; and c) the dawn-converting means is selected to maintain the Stokes-shift energy loss during conversion of light to lower-energy light at less than a predetermined percentage of about 40.

3. The lighting arrangement of claim 2, wherein the predetermined percentage is about 30.

4. The lighting arrangement of claim 1, wherein the light-extracting means is patterned on the light pipe so as to make illuminance over each sequential 10 percent length of the light-extracting means uniform to within 25 percent of the average illuminance along the length of a luminaire; said illuminance being taken orthogonally to said main path and being taken at an angle relative to said main path at which illuminance is a maximum.

5. The lighting arrangement of claim 1, wherein the light-extracting means is patterned on the light pipe over a circumferential swath of the light pipe around said main path so as to direct at least 80 percent of the light from the light-extracting means that passes back through the light pipe and eventually exits the light pipe and is directed towards a target area for illumination and has a spread of less than approximately 180 degrees with respect to said main path.

6. The lighting arrangement of claim 1, wherein the light-extracting means is patterned on the light pipe over a circumferential swath of the light pipe around said main path so as to direct at least 80 percent of the light from the light-extracting means that passes back through the light pipe and eventually exits the light pipe and is directed towards a target area for illumination and has a spread of less than approximately 120 degrees with respect to said main path.

7. The lighting arrangement of claim 1, wherein the light-extracting means is patterned along a swath of an external boundary of the light pipe, taken orthogonal to said main path, to have a non-uniform light-extracting efficiency along the swath.

8. The lighting arrangement claim 1, wherein, for indirectly lighting a target area, the light-extracting means is configured to direct greater than 25 percent of extracted light in the opposite direction from the target area, for reflection back to the target area.

9. The lighting arrangement of claim 1, wherein said wavelength range defines royal blue light.

10. The lighting arrangement of claim 9, wherein the down-converting means and the light-extracting means are selected to result in a composite color of white with a color temperature between 2700 K and 6500 K as used for general purpose illumination.

11. The lighting arrangement of claim 1, wherein the length of light pipe between the first and second ends is greater than 10 times the maximum cross-sectional dimension of the light pipe taken along that length of the light pipe which is primarily illuminated by an LED light source at a only one end of the light pipe.

12. The lighting arrangement of claim 1, further comprising additional light-scattering means, different from said light-extracting means, applied to a length of said sidewall along said main path.

13. The lighting arrangement of claim 12, wherein the additional light-scattering means is intermixed with said light-extracting means.

14. The lighting arrangement of claim 12, wherein the additional light-scattering means is applied atop said light-extracting means.

15. The lighting arrangement of claim 12, wherein the majority of the additional light-scattering means is intermingled with, but not coextensive with, said light-extracting means.

16. The lighting arrangement of claim 1, wherein more than 30 percent of length of the light pipe along a main path of TIR light propagation between said first and second ends has a cross sectional area whose maximum dimension and area are constant to within 95 percent.

17. The lighting arrangement of claim 1, wherein a light coupler is interposed between the first LED light source and the light pipe; the coupler being configured to condition the angular distribution of light to promote total internal reflection of such light within the light pipe.

18. The lighting arrangement of claim 1, wherein a reflector is provided at the second end of the light pipe for reflecting, back towards the first end of the light pipe, light that reaches said second end.

19. The lighting arrangement of claim 18, further comprising a second elongated fiberoptic light pipe, a second LED light source and a light-extracting means having the same construction as defined in claims 1 and 17 for the corresponding like-named parts, the second ends of the first and second fiberoptic light pipes being aligned with each other and being placed in close proximity to each other.

20. The lighting arrangement of claim 1, wherein a second LED light source, comprising at least one LED tuned to provide light within said wavelength range, provides light to the light pipe via said second end.

* * * * *